US008112903B2

(12) United States Patent
Favret et al.

(10) Patent No.: US 8,112,903 B2
(45) Date of Patent: Feb. 14, 2012

(54) HOUSEHOLD CLOTHES DRYING MACHINE WITH ADDITIONAL CONDENSER

(75) Inventors: Ugo Favret, Casarsa (IT); Flavio Noviello, Aviano (IT)

(73) Assignee: Electrolux Home Products Corporation N.V., Brussels (BE)

( * ) Notice: Subject to any disclaimer, the term of this patent is extended or adjusted under 35 U.S.C. 154(b) by 827 days.

(21) Appl. No.: 11/991,847

(22) PCT Filed: Feb. 8, 2007

(86) PCT No.: PCT/EP2007/051206

§ 371 (c)(1),
(2), (4) Date: Apr. 30, 2008

(87) PCT Pub. No.: WO2007/096252

PCT Pub. Date: Aug. 30, 2007

(65) Prior Publication Data

US 2010/0139111 A1 Jun. 10, 2010

(30) Foreign Application Priority Data

Feb. 21, 2006 (EP) ..... 06110243

(51) Int. Cl.
*F26B 11/02* (2006.01)

(52) U.S. Cl. ..... 34/595; 34/601; 34/602; 34/610; 68/18 C; 68/20; 700/275

(58) Field of Classification Search ..... 34/595, 34/601, 602, 603, 606, 610; 68/18 C, 20; 700/275

See application file for complete search history.

(56) References Cited

U.S. PATENT DOCUMENTS 2,717,456 A * 9/1955 Smith ..... 34/75
2,720,037 A * 10/1955 Erickson ..... 34/526
2,743,533 A * 5/1956 Smith ..... 34/547
2,833,056 A * 5/1958 Smith ..... 34/527
2,856,699 A * 10/1958 Frey ..... 34/75

(Continued)

FOREIGN PATENT DOCUMENTS

DE 3446468 A1 * 7/1986

(Continued)

OTHER PUBLICATIONS

International Search Report mailed Apr. 23, 2007 for International Application No. PCT/EP2007/051206.

(Continued)

*Primary Examiner* — Stephen M. Gravini
(74) *Attorney, Agent, or Firm* — Wenderoth, Lind & Ponack, L.L.P.

(57) ABSTRACT

A clothes drying machine comprises a drum (1), a first fan (5) blowing a first flow of drying air through a drying-air conduit, a condenser (3) through which said flow of drying air passes, a cooling-air conduit conveying a second flow of fresh air through said condenser, said second flow being circulated by a second fan (6), and a motor adapted to drive said fans. There is provided an additional condensation element (11) run in parallel of said conduit of drying air, and a respective second air conduit connecting said additional condensation element to said drying air conduit; said additional condensation element is cooled by air at room temperature inside the dryer machine and/or by a wall of it, and the water there condensed is being passed to a common condense recovery reservoir (10).

20 Claims, 3 Drawing Sheets

AIRFLOW SCHEMATICS

U.S. PATENT DOCUMENTS

| | | | | |
|---|---|---|---|---|
| 3,022,581 | A * | 2/1962 | Smith | 34/75 |
| 3,132,005 | A * | 5/1964 | McMillan | 34/569 |
| 3,266,166 | A * | 8/1966 | Fuhring | 34/469 |
| 3,805,404 | A * | 4/1974 | Gould | 34/75 |
| 3,816,070 | A * | 6/1974 | Candor et al. | 8/158 |
| 4,204,339 | A * | 5/1980 | Muller | 34/75 |
| 4,316,726 | A * | 2/1982 | Hopper | 95/214 |
| 4,370,816 | A * | 2/1983 | Zambelli | 34/76 |
| 4,459,831 | A * | 7/1984 | Grandi | 68/18 R |
| 4,499,743 | A * | 2/1985 | Maestrelli | 68/18 C |
| 4,519,145 | A * | 5/1985 | Mandel | 34/389 |
| 4,757,699 | A * | 7/1988 | Arreghini et al. | 68/16 |
| 4,989,995 | A * | 2/1991 | Rubenstein et al. | 383/117 |
| 5,082,466 | A * | 1/1992 | Rubenstein et al. | 8/142 |
| 5,090,431 | A * | 2/1992 | Theroux et al. | 134/105 |
| 5,146,693 | A * | 9/1992 | Dottor et al. | 34/77 |
| 5,606,878 | A * | 3/1997 | Arreghini et al. | 68/17 R |
| 6,076,271 | A * | 6/2000 | Kobayashi et al. | 34/77 |
| 6,530,245 | B1 * | 3/2003 | Kawabata et al. | 68/20 |
| 6,671,978 | B1 * | 1/2004 | McGowan et al. | 34/596 |
| 6,748,772 | B2 * | 6/2004 | Lee et al. | 68/18 C |
| 6,966,203 | B2 * | 11/2005 | Matsuda et al. | 68/12.15 |
| 7,017,282 | B2 * | 3/2006 | Pyo et al. | 34/596 |
| 7,021,088 | B2 * | 4/2006 | Hong et al. | 68/20 |
| 7,121,018 | B2 * | 10/2006 | Lee | 34/595 |
| 7,228,647 | B2 * | 6/2007 | Hong | 34/596 |
| 7,275,399 | B2 * | 10/2007 | Park et al. | 68/18 C |
| 7,302,815 | B2 * | 12/2007 | Kim et al. | 68/18 C |
| 7,415,848 | B2 * | 8/2008 | Jeong et al. | 68/18 C |
| 7,481,083 | B2 * | 1/2009 | Habu et al. | 68/19.2 |
| 7,695,524 | B2 * | 4/2010 | Wright et al. | 8/142 |
| 7,739,891 | B2 * | 6/2010 | Luckman et al. | 68/124 |
| 7,757,521 | B2 * | 7/2010 | Hong | 68/20 |
| 7,837,741 | B2 * | 11/2010 | Kerpels et al. | 8/142 |
| 7,908,766 | B2 * | 3/2011 | Ahn et al. | 34/595 |
| 7,926,202 | B2 * | 4/2011 | Dittmer et al. | 34/595 |
| 7,966,684 | B2 * | 6/2011 | Wright et al. | 8/158 |
| 7,980,002 | B2 * | 7/2011 | Eichler | 34/359 |
| 2006/0201020 | A1 * | 9/2006 | Cimetta et al. | 34/468 |
| 2006/0218812 | A1 * | 10/2006 | Brown | 34/86 |
| 2009/0094854 | A1 * | 4/2009 | Cimetta et al. | 34/562 |
| 2010/0139111 | A1 * | 6/2010 | Favret et al. | 34/76 |

FOREIGN PATENT DOCUMENTS

| | | | |
|---|---|---|---|
| DE | 4306217 | A1 * | 9/1994 |
| DE | 4434205 | A1 * | 3/1996 |
| DE | 19508244 | A1 * | 9/1996 |
| EP | 250870 | A2 * | 1/1988 |
| EP | 543166 | A1 * | 5/1993 |
| EP | 575759 | A1 * | 12/1993 |
| EP | 0 699 795 | | 3/1996 |
| EP | 1 591 579 | | 11/2005 |
| EP | 1820893 | A1 * | 8/2007 |
| EP | 2028312 | A2 * | 2/2009 |
| FR | 2 261 490 | | 9/1975 |
| GB | 2 059 035 | | 4/1981 |
| WO | WO 2006062261 | A1 * | 6/2006 |

OTHER PUBLICATIONS

Written Opinion of the International Searching Authority mailed Apr. 23, 2007 for International Application No. PCT/EP2007/051206.

International Preliminary Report on Patentability mailed Jan. 18, 2008 for International Application No. PCT/EP2007/051206.

* cited by examiner

FIG. 1: AIRFLOW SCHEMATICS

HOUSEHOLD CLOTHES DRYING MACHINE WITH ADDITIONAL CONDENSER

BACKGROUND OF THE INVENTION (1) Field of the Invention

An improved kind of household clothes drying machine which is provided with an auxiliary condenser in order to reduce the energy consumption and the time required to perform a normal drying cycle is here described.

(2) Description of Related Art

The known condenser drying machines are generally provided with means for removing the moisture from the drying air comprising a condenser through which there is conveyed, further to the flow of the drying air itself, a second flow of cooling air, occurring of course separately from said flow of drying air, which is taken in from the outside ambient and appropriately delivered to flow through and, as a result, cool down said condenser.

Although reference to an autonomous, i.e. self-standing clothes drying machine will be made throughout the following description, it shall be appreciated that what is set forth below may similarly be applied to and, therefore, be suitable for combined clothes washing and drying machines.

The machines, which the present invention refers to, are generally known in the art. They have on the other hand been described, along with a detailed discussion of a technical nature on the advantages and the drawbacks of a number of different variations in the design and general embodiment thereof, in the European Patent Application no. 03028410.3 and no. 04101800.3, filed by this same Applicant to which reference should therefore be made for reasons of greater convenience and brevity of this description.

The present invention preferably applies to clothes drying machines which, further to a condenser, are also provided with:

two distinct fans for blowing the drying air and the condenser cooling air, respectively, a single motor adapted to drive both said fans at the same time, said motor being adapted to be controlled so as to selectively rotate in the two opposite directions.

However, it will be readily appreciated that the present invention may be equally applied to condenser-type clothes drying machines of a traditional kind, i.e. provided with a regular condenser, but lacking the other features as indicated above.

Largely known in the art are clothes drying machines that operate either by condensing a flow of hot air, which is first blown into the clothes-holding drum and, while circulating therethrough, removes moisture from the same clothes, or by exhausting said flow of hot moisture-laden air directly outside.

Upon having been blown into the clothes-holding drum, the hot air causes the moisture contained in the clothes to evaporate, thereby becoming almost saturated, or even fully saturated, therewith. This hot, moisture-laden air is then pushed further by said fan, thereby creating a continuous flow that is eventually sent into an appropriate condensation arrangement, which is usually constituted by a heat-exchanger flown through—along the so called "hot" path—by said flow of hot moisture-laden air and—along the so-called "cold" path—by a substantially continuous flow of fresh air that is taken in from the outside ambient and is exhausted again into the outside ambient upon having so flown through said heat-exchanger. Usually, even said flow of fresh air in the so-called "cold" path is activated and maintained by a fan, which is driven in a traditional manner by a respective electric motor.

Largely known in the art is also the fact that, during the initial phase of the drying process, no need would be actually felt for the drying air to be caused to undergo such moisture removal process by letting it pass through the condenser, since it in fact undergoes a certain extent of condensation by itself owing to a still quite low temperature prevailing in the machine. Moreover, during the initial phase of the drying process, the need arises for both the clothes to be dried and the drying air itself to be heated up to the steady-state temperature thereof, so that, in this initial period, condensation taking place at the condenser would anyway be quite limited and, therefore, would make a cooling down of the drying air plainly useless, if not even detrimental.

However the solutions of the prior art all show the common feature that the whole flow of drying air is always made to pass across the condenser or, if existing, the two stage condenser of the latter cited prior art.

This means that this flow of moisture-laden air flow is continuously returned to the drum; when, particularly in the initial phase of the drying cycle, said "hot" air is quite humid, a certain amount of said moisture is unavoidably returned into the drum, independently of the efficiency of the condensing process.

Therefore the presence of moisture that is being circulated from the drum to the condenser, and from it back to the drum, without being effectively condensed, causes an increase of the time length of the drying cycle and an increase of the energy consumption.

It would therefore be desirable, and it is actually a main purpose of the present invention, to provide a condenser-type clothes drying machine, which is capable of ensuring a standard level drying performance, and is however capable of eliminating the above-cited drawbacks of recirculation of the moisture-laden air and the resulting unwanted increase of energy consumption.

According to the present invention, this aim is reached, along with further ones that will be apparent from the following description, in a condenser-type clothes drying machine incorporating the features as recited in the appended claims.

BRIEF DESCRIPTION OF THE DRAWINGS

Other features and advantages of the present invention will be more readily understood from the description that is given below by mere way of non-limiting example with reference to the accompanying drawings, in which.

DETAILED DESCRIPTION OF THE INVENTION

Figure 1:
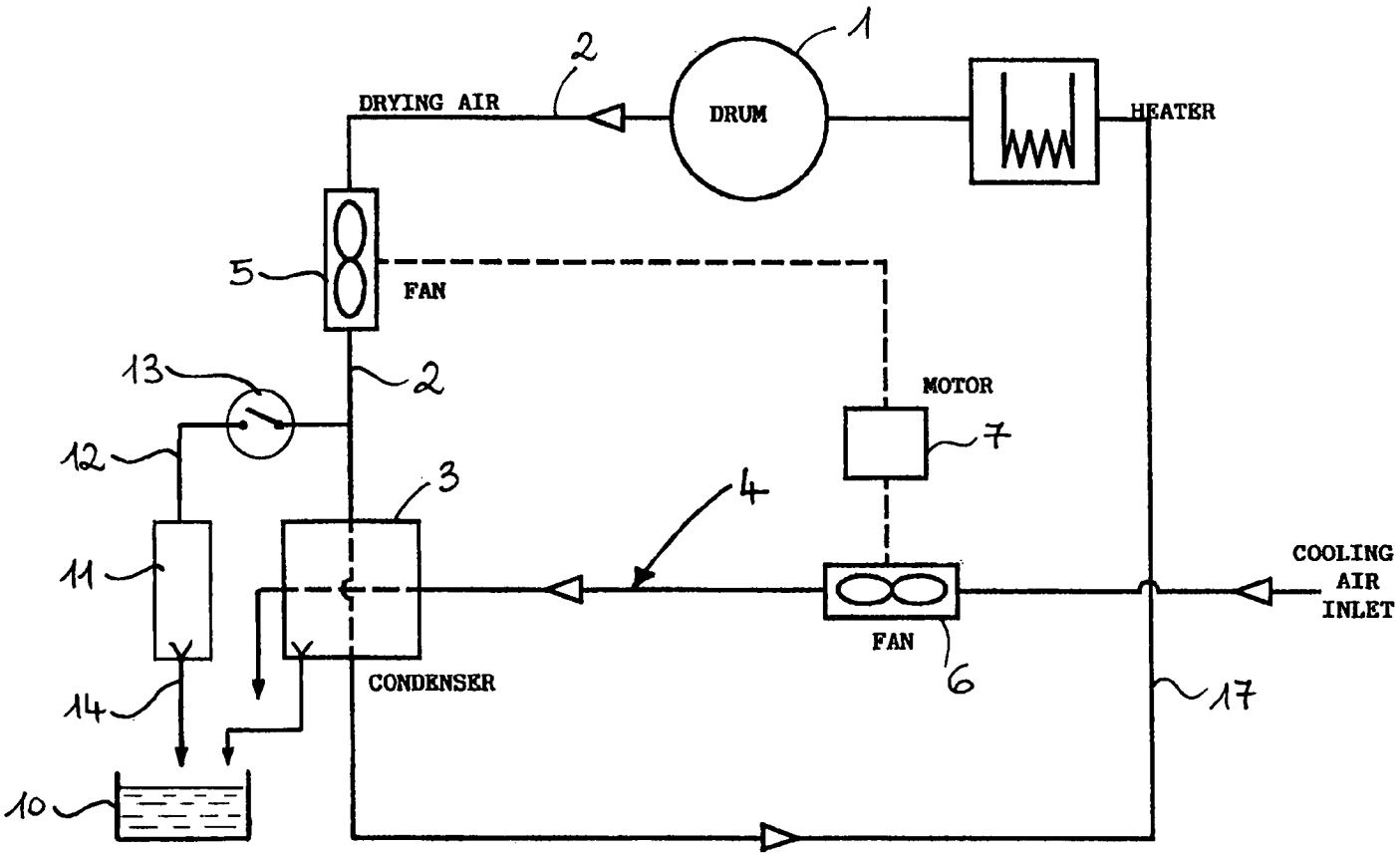
FIG. 1 shows a schematic view of the different operational devices duly connected and used in a machine according to the present invention.

In a clothes drying machine according to a prior-art embodiment there is provided a drum 1 adapted to hold the clothes to be dried, to which there is associated a first conduit 2 for the circulation of the drying air; the latter flows also through a condenser 3, which is adapted to cause the moisture contained in the drying air flowing therethrough to condense, said condenser being furthermore flown through by a flow of "cold" air, i.e. air taken in from the outside ambient and sent to said condenser 3 via a corresponding conduit 4.

Both conduits 2 and 4 contain two respective fans 5, 6 therewithin, which are provided to circulate the drying-air flow and the cooling-air flow, respectively. Furthermore, the shafts of said two fans 5 and 6 are connected in any of the manners known as such in the art, even via appropriate mechanisms and gears, to respective motors, not shown, or a single motor, schematically shown.

According to the present invention, said machine is improved in the following manner: with reference to FIG. 1, an additional condenser 11 is provided and connected in parallel to said first condenser 3; said additional condenser is actually a simple hollow body which is crossed by a part of the drying air flow leaving the drum 1 and is being conveyed into said first conduit 2 of the drying air.

Moreover said additional condenser 11 is not run by a specific flow of cooling air, and therefore its cooling function is performed only by the natural cooling of the room air.

Therefore said additional condenser 11 is preferably arranged onto contact to a wall of the machine cabinet, which is cooled by the room surrounding the same machine. Said additional condenser 11 is connected to said first conduit 2 of drying air by means of a second conduit of cooling air 12, which branches out from said first conduit 2 in a position obviously upstream of said first condenser.

The warm and moisture-laden air which enters into said additional condenser 11 is then discharged into the room by means of a third conduit 14; this fact is made possible as the amount of air which is in this way expelled from the drying circuit is also restored by the small holes and apertures existing in the same circuit, and particularly by the air which is sucked by the slots 15 existing between the drum and the drying air conduits, which enters into it and exit from it.

The advantage of such solution resides in the fact than the air, still a little hot but very humid, which crosses the first conduit 2 of drying air, is not entirely cooled in the first condenser 3, but part of it is simply discharged, together with the humidity therein contained.

The natural and immediate effect of such solution is that the condenser 3 is run by less drying air, and therefore that air flows with a lower speed, so improving the thermal exchange across said condenser 3; however it is apparent that a part of said humidity remains diffused in the same drying air to enter again into the drum again, after having been heated.

Obviously such remaining humidity is opposing to the drying action and, in the same apparent way, if such remaining humidity is being reduced, due to the action of said additional condenser 11 which intercepts and discharges a part of said drying air, the final effect consists on an improvement of the energy consumption and of the time-length of the drying cycle.

It has to be observed a further benefit of the invention: in the facts the air flow crossing the additional condenser 11 is very little, and therefore said condenser 11 allows that the air-flow going out from it contains practically the same amount of humidity as the room atmosphere.

Figure 4:
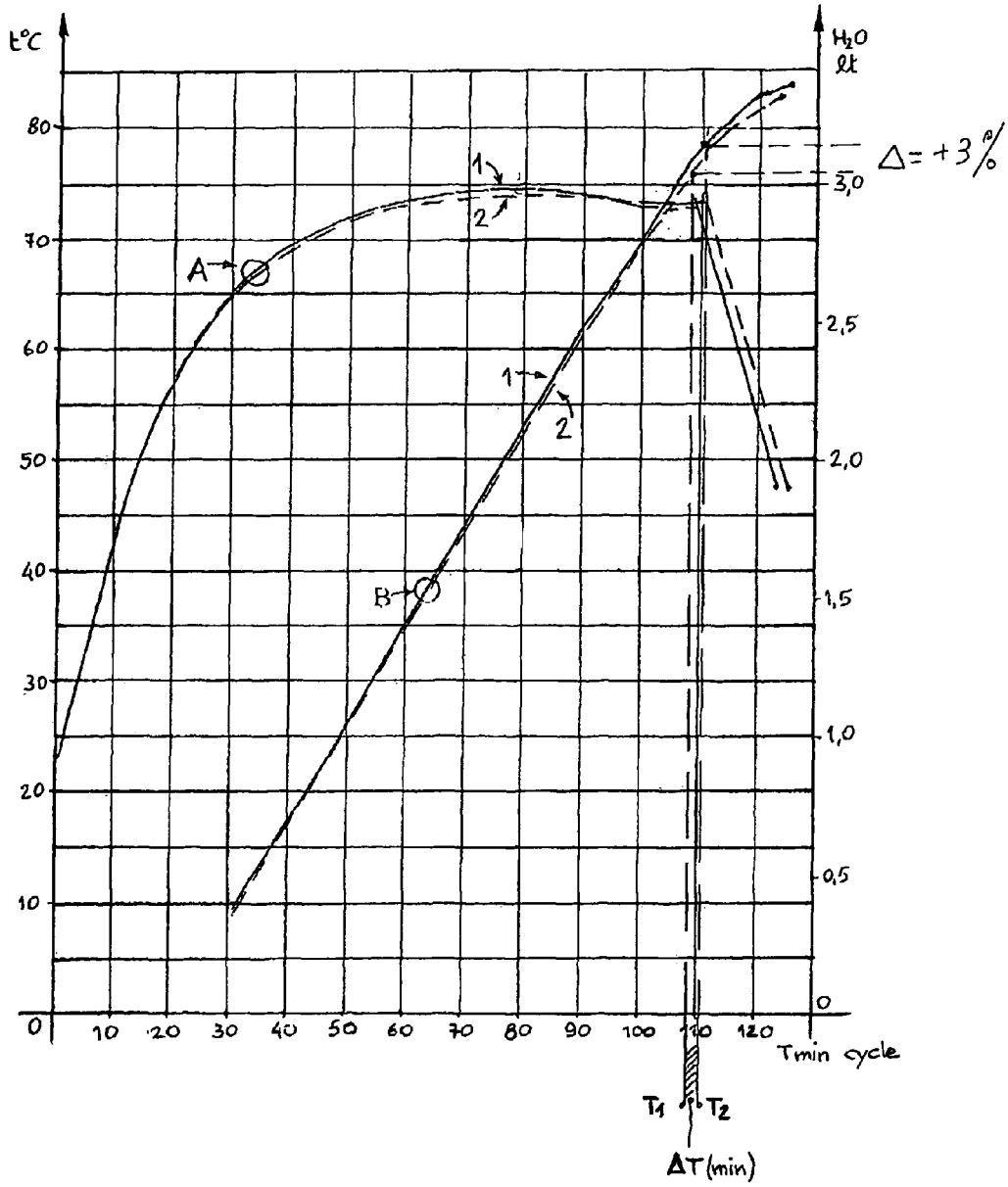
FIG. 4 shows the compared diagrams of the condensed water quantity and of the air temperature leaving the drum in a machine with and without the invention.

The benefit of the invention can also be well described in the FIG. 4; it represents the drying performances in a drying machine in the two different tests referred to two different conditions, i.e. when the condenser 3 only operates, and when both the condenser 3 and the additional condenser 11 are activated in the same time, the valve 13 being opened; of course to be technically correct, the two tests have been made on the same machine, and with all the other conditions unchanged; it is apparent the increase of around 3% of the condensed water at the end of the test, that corresponds to a typical drying cycle, in an household drying machine.

More specifically, the effects of the invention can be easily checked both for the temperature of the air leaving the drum (curves "A") and for the water which is condensed during the drying cycle (curves "B"), respectively with the additional condenser 11, and without it (curves 1 and 2).

Specifically it has been noted than the stronger effect, and therefore the best benefit, can be achieved during the cycle intermediate phase; in the facts during said phase two different conditions take place in the same time, i.e. the load is still very moisture-laden, and the drying air is already hot enough; such conditions, taken together, cause the effect that the amount of humidity removal in the drying air reaches its maximum.

Therefore, as above explained, the more air that is discharged from the drying circuit in said condition, the more water is eliminated, and therefore the higher is also the improvement in the general efficiency of the drying cycle.

Figure 2:
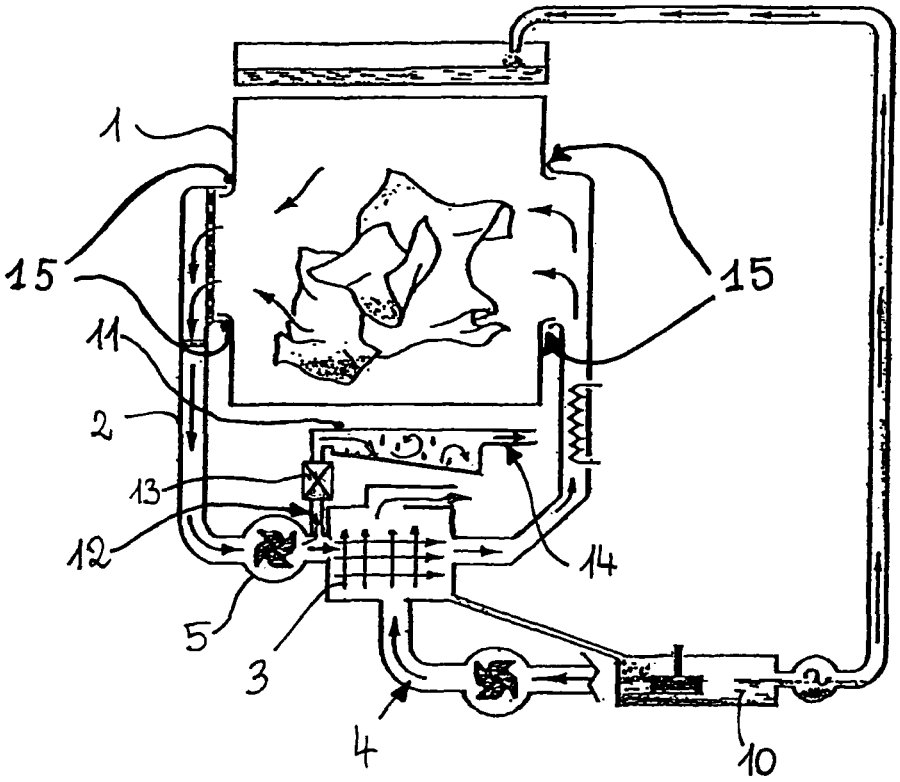
FIG. 2 is a top, cut-away view of a significant portion of the condenser and associated devices in a machine according to the present invention.
Figure 3:
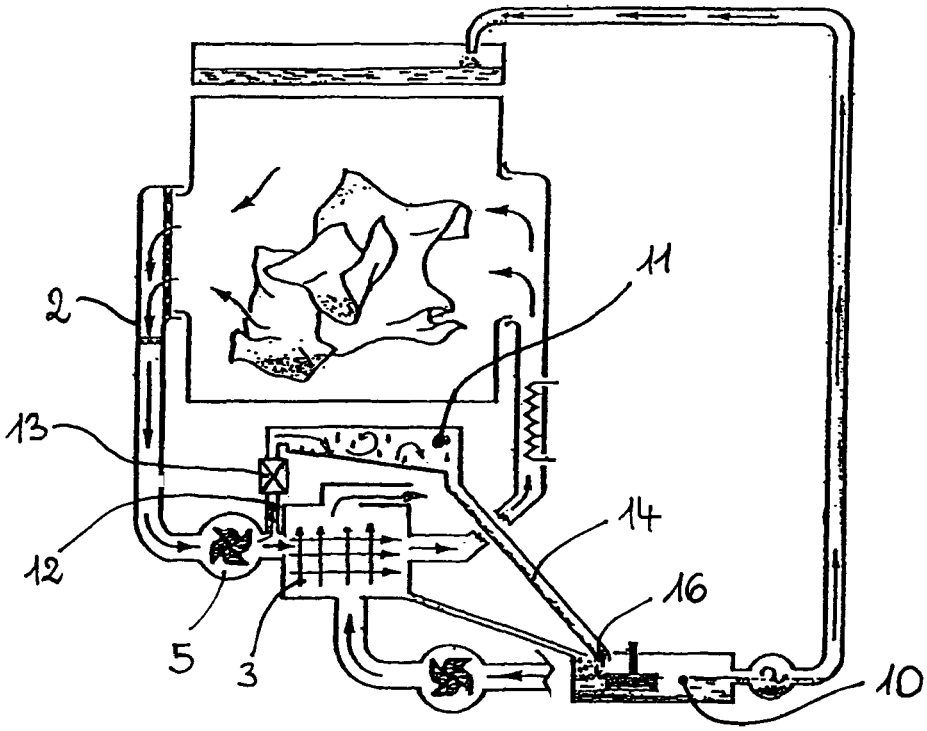
FIG. 3 shows a further improved embodiment of the back wall of the machine seen in FIG. 2.

With reference to FIGS. 2 and 3, an advantageous embodiment of the instant invention is providing a valve 13, preferably of the kind of a flap, placed on said first conduit 2 to said second conduit 12; such a valve may be activated into any position, using generally well known and not shown means, according to pre-defined settings of the drying cycle.

Particularly it can be preferred that said valve 13 is being opened and let open (said first conduit 2 is permanently connected both to said first condenser 3, and to said second conduit 12) only during an intermediate phase of the drying cycle, and is being automatically closed (additional condenser 11 excluded) during the remaining phases of the drying cycle.

After having been blown into said additional condenser 11, the respective air has to be obviously discharged from it; to this purpose, a third conduit 14 is provided, which connects the inner volume of said additional condenser 11 to the outer room, to which the air is discharged due to the pressure provided by the first fan 5, which works in said first conduit 2 of the drying air, and that advantageously is placed upstream of said valve 13.

Of course the condensed water generated by said additional condenser 11 has to be discharged as well, and this function may be implemented using various means and modes generally well known; however a particularly favorite way is that one shown in the FIG. 3, wherein it is represented that the downstream mouth 16 of said third conduit 14 is placed exactly over the same reservoir 10, which collects the condensed water coming form said first condenser 3.—The improvement consists in that only a reservoir is needed, and only one operation to empty it from the water there poured by the two condensers is required.

Moreover it will be easily understood that the preferred solution is one generally represented in FIG. 2, which shows that the first fan 5 is placed in the part of said first conduit 2 comprised between the exit mouth of said drum 1 and upstream of the branching point in parallel of said second conduit 12, so that the additional condenser 11 can benefit of the maximum pressure provided by said first fan 5.

The invention claimed is:

1. A clothes drying machine comprising:

a drum for holding clothes to be dried;

a first condenser;

a second condenser placed in parallel to said first condenser;

a first fan adapted to blow a first flow of drying air;

a first conduit for recirculation of the first flow of drying air through said first fan, through said drum, and through said first condenser;

a cooling-air conduit conveying a second flow of fresh air through said first condenser;

a second fan installed in said cooling-air conduit and circulating the second flow of fresh air through said cooling-air conduit;

a water reservoir for collecting water condensed by said first condenser; and a second air conduit connecting said second condenser to said first conduit upstream of said first condenser such that operation of said first fan will send a part of the first flow to said second condenser through said second air conduit.

2. The clothes drying machine of claim 1, wherein a valve is arranged in said second air conduit and is adapted to selectively shut off/open the passage towards said second condenser.

3. The clothes drying machine of claim 1, further comprising a third duct for conveying the water condensed by said second condenser into said water reservoir.

4. The clothes drying machine of claim 1, wherein said first fan is placed in said first conduit between said drum and a region upstream of the parallel branching between said first condenser and said second condenser.

5. The clothes drying machine of claim 2, wherein the machine is able to automatically open said valve between said first air conduit and said second air conduit during an intermediate phase of the drying cycle.

6. The clothes drying machine of claim 1, wherein said second condenser is placed in close contact to a wall of the machine cabinet.

7. The clothes drying machine of claim 2, further comprising a third duct for conveying the water condensed by said second condenser into said water reservoir.

8. The clothes drying machine of claim 2, wherein said first fan is placed in said first conduit between said drum and a region upstream of the parallel branching between said first condenser and said second condenser.

9. The clothes drying machine of claim 3, wherein said first fan is placed in said first conduit between said drum and a region upstream of the parallel branching between said first condenser and said second condenser.

10. The clothes drying machine of claim 3, wherein the machine is able to automatically open said valve between said first air conduit and said second air conduit during an intermediate phase of the drying cycle.

11. The clothes drying machine of claim 4, wherein the machine is able to automatically open said valve between said first air conduit and said second air conduit during an intermediate phase of the drying cycle.

12. The clothes drying machine of claim 2, wherein said second condenser is placed in close contact to a wall of the machine cabinet.

13. The clothes drying machine of claim 3, wherein said second condenser is placed in close contact to a wall of the machine cabinet.

14. The clothes drying machine of claim 4, wherein said second condenser is placed in close contact to a wall of the machine cabinet.

15. The clothes drying machine of claim 5, wherein said second condenser is placed in close contact to a wall of the machine cabinet.

16. The clothes drying machine of claim 7, wherein said first fan is placed in said first conduit between said drum and a region upstream of the parallel branching between said first condenser and said second condenser.

17. The clothes drying machine of claim 7, wherein the machine is able to automatically open said valve between said first air conduit and said second air conduit during an intermediate phase of the drying cycle.

18. The clothes drying machine of claim 8, wherein the machine is able to automatically open said valve between said first air conduit and said second air conduit during an intermediate phase of the drying cycle.

19. The clothes drying machine of claim 9, wherein the machine is able to automatically open said valve between said first air conduit and said second air conduit during an intermediate phase of the drying cycle.

20. The clothes drying machine of claim 16, wherein the machine is able to automatically open said valve between said first air conduit and said second air conduit during an intermediate phase of the drying cycle.

* * * * *